US007562959B2

(12) United States Patent
Suzuki

(10) Patent No.: US 7,562,959 B2
(45) Date of Patent: Jul. 21, 2009

(54) INK-JET PRINTING DEVICE

(75) Inventor: Ryohei Suzuki, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 543 days.

(21) Appl. No.: 11/525,676

(22) Filed: Sep. 22, 2006

(65) Prior Publication Data

US 2007/0139464 A1 Jun. 21, 2007

(30) Foreign Application Priority Data

Sep. 30, 2005 (JP) ..... 2005-286235

(51) Int. Cl.
*B41J 2/165* (2006.01)

(52) U.S. Cl. ..... 347/29; 347/23; 347/30; 347/32; 347/33

(58) Field of Classification Search ..... 347/29, 347/23, 30, 32, 33
See application file for complete search history.

(56) References Cited

U.S. PATENT DOCUMENTS

| | | | | |
|---|---|---|---|---|
| 6,017,109 | A | 1/2000 | Saijo | |
| 6,312,092 | B1 | 11/2001 | Usui et al. | |
| 6,540,322 | B2 | 4/2003 | Usui et al. | |
| 6,616,265 | B2 * | 9/2003 | Shindo et al. | 347/29 |
| 6,623,098 | B2 * | 9/2003 | Davis | 347/29 |
| 6,918,650 | B2 | 7/2005 | Umeda et al. | |

FOREIGN PATENT DOCUMENTS

| | | |
|---|---|---|
| JP | 2000052567 | 2/2000 |
| JP | 2000238276 | 9/2000 |
| JP | 2002225314 | 8/2002 |
| JP | 2003001839 | 1/2003 |
| JP | 2005-161803 | 6/2005 |

* cited by examiner

*Primary Examiner*—Shih-wen Hsieh
(74) *Attorney, Agent, or Firm*—Reed Smith LLP

(57) ABSTRACT

An ink-jet printing device is presented including (1) an ink-jet printing head for printing an image by discharging ink droplets from a number of nozzles onto a recording medium and (2) a purging unit for sucking ink from the nozzles. The purging unit includes a cap, a suction pump, and a supporting member. The cap has a flat, plate shaped base, and a cylindrical lip that extends upright from the base. When the lip of the cap is in abutment with the ink-jet printing head, the suction pump lowers the pressure in a space defined between the ink-jet printing head and the cap. The supporting member is disposed in the cap and is capable of supporting the lip from the inside of the cap. When a distal end portion of the lip abuts the ink-jet printing head, the lip hermetically encloses the nozzles. At least a portion of the base corresponding to the inner side of the lip is flexible enough to be deformed so as to project inwardly of the lip when the pressure in the space is lowered. The supporting member includes an abutment portion, the abutment portion abutting the inner side of the distal end portion of the lip when the base deforms.

16 Claims, 15 Drawing Sheets

INK-JET PRINTING DEVICE

The present invention is based on Japanese Patent Application Ser. No. 2005-286235 filed Sep. 30, 2005, the contents of which are incorporated by reference.

BACKGROUND OF THE INVENTION

1. Field of the Invention

The present invention relates to a structure of an ink-jet printing device containing an ink-jet printing head for discharging ink droplets from a nozzle.

2. Discussion of Related Art

An ink-jet printing device prints an image on a sheet placed on a platen by discharging ink droplets from an ink-jet printing head. The ink-jet printing head includes a plurality of nozzles. Generally, the nozzles discharge black ink and color inks, such as yellow ink, magenta ink, and cyan ink. In this case, each nozzle does not discharge all the color inks, and nozzles corresponding to the respective inks are determined in advance.

The ink-jet printing device is not necessarily used constantly. When it is used as a family device, it is supposed that the frequency of usage is low. When the ink-jet device is not used, it is exposed to the outside air. When the nozzles of the ink-jet printing head are exposed to the outside air, ink in the nozzles becomes dried, and viscosity of the ink increases. Even when printing is performed frequently, an image formed on the sheet is not necessarily a color image using multi-color ink. As a result, ink droplets are not discharged constantly from all the nozzles. Therefore, in the nozzles which are used less frequently, ink becomes dried in the nozzles, increasing the viscosity of the ink. Assuming that the ink is dried in the nozzles, and the viscosity of the ink is increased, the ink droplets cannot be discharged desirably from the nozzles. Therefore, in the related art, the ink-jet printing device is provided with a waiting cap member for sealing the nozzles of the ink-jet printing head when not actively printing. In addition, in order to solve or prevent clogging of the nozzles due to increase in viscosity of ink, a purging device for sucking ink from the nozzles is also provided. The purging device includes a purging cap member for covering the ink-jet printing head, so as to enclose the nozzles, and a sucking unit connected to the purging cap member. When the sucking unit is activated, the pressure in the purging cap member is lowered, whereby ink is sucked from the nozzles. By sucking the ink from the nozzles, increases in the viscosity of the ink in the respective nozzles are avoided. In this manner, clogging of the nozzles is solved. The waiting cap member and the purging cap member may be composed separately or may be identical, depending on the type of the ink-jet printing device.

In order that the sucking unit sucks the ink desirably, it is necessary that the purging cap member encloses the nozzles hermetically without fault. In order to do so, it is preferable that the purging cap member is formed of a material having sufficient flexibility. However, in order to achieve reliable suction of ink from the nozzles, it is necessary to lower the pressure in the cap member significantly. Therefore, the purging cap member is required to have sufficient rigidity, such that deformation of the purging cap is prevented even when the pressure in the interior of the purging cap is less than the pressure outside the purging cap. This is because deformation of the purging cap member hinders the purging cap member from hermetically enclosing the nozzles. In addition, when a deformed purging cap member comes into contact with the nozzles, ink meniscuses formed in the respective nozzles are broken, and suction of ink from the respective nozzles may be impaired.

In the ink-jet printing device in the related art, various improvements are made to the cap member for achieving both flexibility for enclosing the nozzles hermetically, and rigidity for preventing the cap member from being easily deformed during ink suction. For examples of such improvements, see JP-A-2005-161803, JP-A-2003-1839, JP-A-2000-238276, and JP-A-2000-52567.

In recent years, the ink-jet printing head has been upsized in order to print the image more precisely at a high speed. In addition, the number of nozzles has been increased. As a result, the cap member has been upsized, requiring the sucking unit to provide a greater suction force. When the suction force provided by the sucking unit is increased, the likelihood of cap member deformation is increased, and a new countermeasure for preventing such deformation is required.

SUMMARY OF THE INVENTION

In accordance with one embodiment of the current invention, an ink-jet printing device is presented comprising (1) an ink-jet printing head for printing an image by discharging ink droplets from a number of nozzles onto a recording medium and (2) a purging unit for sucking ink from the nozzles. The purging unit comprises a cap, a suction pump, and a supporting member. The cap has a flat, plate shaped base, and a cylindrical lip that extends upright from the base. When the lip of the cap is in abutment with the ink-jet printing head, the suction pump lowers the pressure in a space defined between the ink-jet printing head and the cap. The supporting member is disposed in the cap and is capable of supporting the lip from the inside of the cap. When a distal end portion of the lip abuts the ink-jet printing head, the lip hermetically encloses the nozzles. At least a portion of the base corresponding to the inner side of the lip is flexible enough to be deformed so as to project inwardly of the lip when the pressure in the space is lowered. The supporting member comprises an abutment portion, the abutment portion abutting the inner side of the distal end portion of the lip when the base deforms.

In accordance with yet another embodiment of the current invention, an ink-jet printing device is presented comprising an ink-jet printing head and a purging unit. The purging unit comprises a cap, a suction pump, and a supporting member. The cap has a base and a lip, wherein the lip extends from the base. The supporting member is located inside the cap. When the cap is brought into abutment with the ink-jet printing head, a space is formed between the cap and the ink-jet printing head and a hermetic seal is formed between the lip of the cap and the ink-jet printing head. The suction pump lowers the pressure of the space when the suction pump is activated. The supporting member moves in a direction away from the base of the cap when the suction pump is activated, thereby supporting the lip so that the hermetic seal between the lip of the cap and the ink-jet printing head is maintained.

DETAILED DESCRIPTION OF EMBODIMENTS

Figure 1:
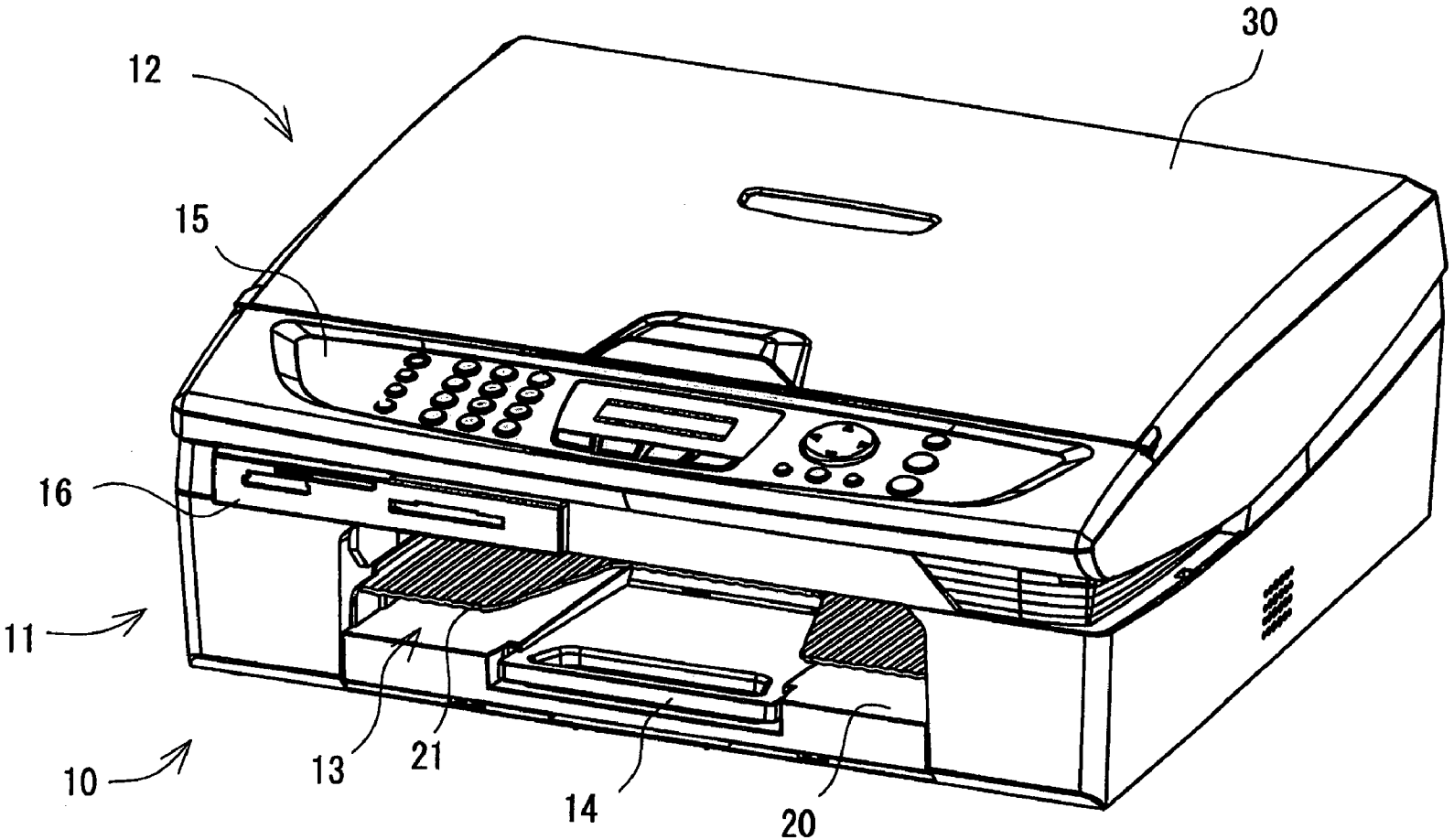
FIG. 1 is a perspective view showing an appearance configuration of a multi-function device (ink-jet printing device) according to an embodiment of the present invention.

Referring now to the drawings, the present invention will be described in detail on the basis of exemplary embodiments.

Referring to FIG. 1, the multi-function device 10 is integrally provided with a printer 11 on a lower portion thereof and a scanner 12 on an upper portion thereof and includes a printer function, a scanner function, and a copy function. In this embodiment, the printer 11 corresponds to the ink-jet printing device according to the present invention. Functions other than the printer function are optional. Therefore, the present invention may be implemented, without the scanner 12, as a mono-function printer having no scanner function or copy function. Similarly, the present invention may be implemented as a multi-function device further having a communication unit for performing a facsimile function.

When the present invention is implemented as a multi-function device, it may be a compact type, such as the multi-function device 10 according to the present embodiment, or it may be a large-scale device having a plurality of sheet feed cassettes or an ADF (auto document feeder). In the present embodiment, the multi-function device 10 is usually connected to a computer, not shown, and is able to print an image or text on a recording medium based on image or text data transmitted from the computer. Typically, the recording media is a sheet of paper or a resin film (hereinafter, referred to as a "sheet"). The multi-function device 10 may also be connected to a digital camera or the like. As a result, the multifunction device 10 is able to print an image on a sheet based on image data from the digital camera itself. Furthermore, the multifunction device 10 may be loaded with various memory media, and is able to print an image on a sheet based on the image data stored in the loaded memory media.

As shown in FIG. 1, the width and the depth of the multi-function device 10 are each greater than the height, making the external shape of the multi-function device wide and thin. The printer is located in the lower portion of the multi-function device 10. The printer 11 is formed with an opening 13 on a front face. A sheet feed tray 20 and an output tray 21 are provided so as to be exposed from the opening 13. The sheet feed tray 20 is used for storing the sheets. The sheet feed tray 20 can accommodate sheets of A4 size and various smaller sizes, including but not limited to B5 size and postcard size. The sheet feed tray 20 includes a slide tray 14. The slide tray 14 is pulled out as needed for enlarging a tray surface. The sheets stored in the sheet feed tray 20 are fed to the interior of the printer 11, and outputted to the output tray 21 after a desired image has been recorded on the sheet as described later.

Figure 2:
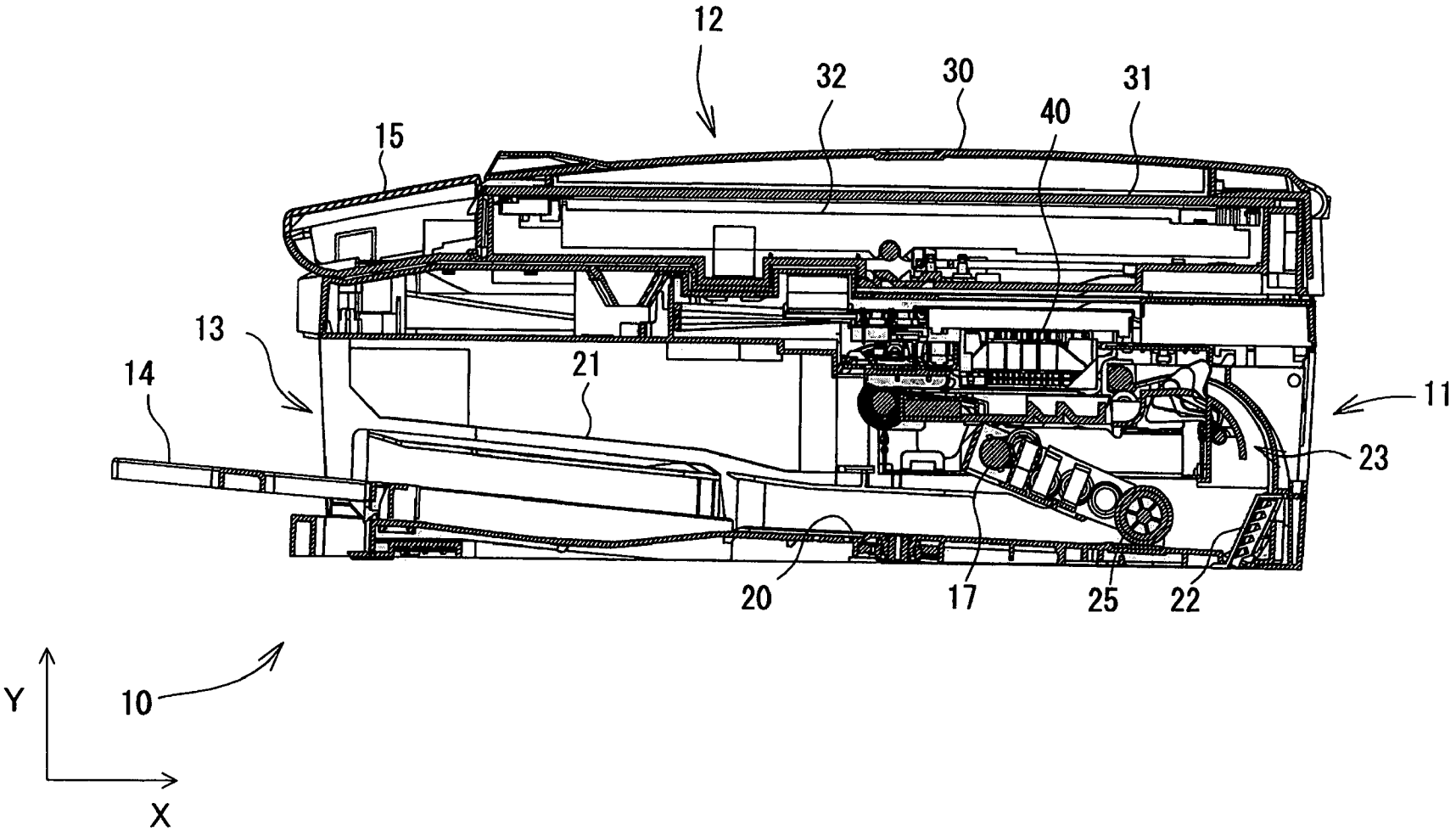
FIG. 2 is a cross-sectional view of the multi-function device according to the embodiment of the present invention.

Referring to FIG. 2, the scanner 12 is located in the upper portion of the multi-function device 10. The scanner 12 is configured as a flat-bed scanner. As shown in FIG. 1 and FIG. 2, the multi-function device 10 is provided with a document cover 30. The document cover 30 is provided as a top plate of the multi-function device 10, and is openable and closable. A platen glass 31 and a scanning carriage 32 are provided under the document cover 30. A document, whose image is to be read, is placed on the platen glass 31. The scanning carriage 32 is arranged below the platen glass 31. The main scanning direction of the scanning carriage 32 matches the X direction of FIG. 2. Therefore, to read the image from the document, the scanning carriage 32 slides in the widthwise direction of the multi-function device 10, which matches the direction perpendicular to the XY plane of FIG. 2.

An operation panel 15 is provided on top of the front side of the multi-function device 10. The operation panel 15 operates both the printer 11 and the scanner 12, as well as the multi-function device 10. The operation panel 15 includes various operating buttons and a liquid crystal display. When a computer is connected to the multi-function device 10, the multi-function device 10 may also be operated by an instruction transmitted from the computer via a printer driver. A slot unit 16 is provided on an upper left portion of the front face of the multi-function device 10. The slot unit 16 is adapted to load various types of compact memory cards as memory media. The image data stored in the various compact memory cards is read by the multi-function device 10. The image data read from the various compact memory cards is displayed on the liquid crystal display. A user of the multi-function device 10 can select a desired image displayed on the liquid crystal display by operating the operation panel 15, and print the image on a sheet by the printer 11.

Figure 3:
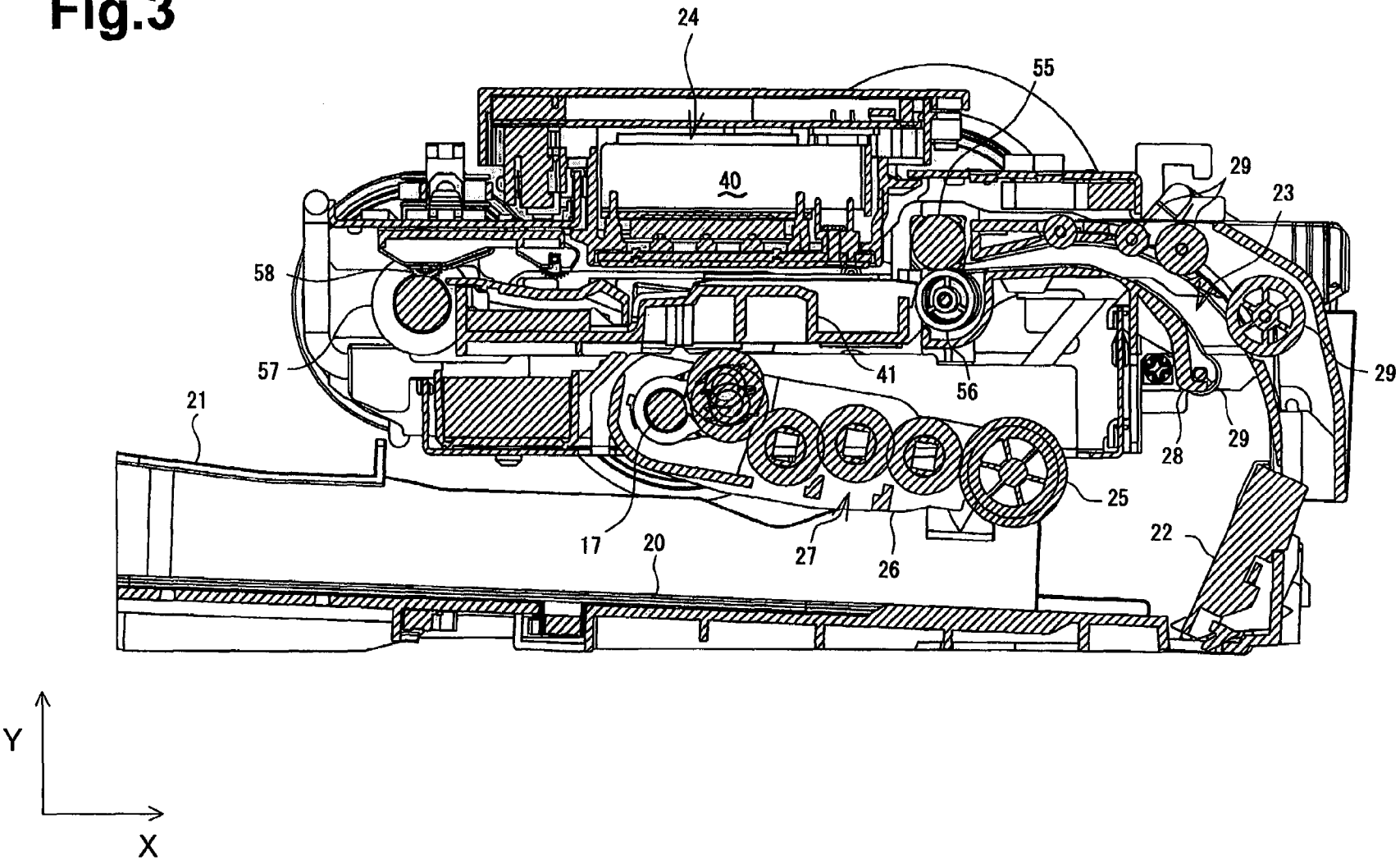
FIG. 3 is a cross-sectional view of a printer of the multi-function device according to the embodiment of the present invention.

As shown in FIG. 2 and FIG. 3, an inclined separation plate 22 is provided on the inner side (the right side in FIG. 2 and FIG. 3) of the sheet feed tray 20. The inclined separation plate 22 is a member for separating the sheets stacked on the sheet feed tray 20 and guiding the same upward. A transport path 23 is formed from the inclined separation plate 22 upward. As shown in FIG. 3, the transport path 23 extends upward, and then curves toward the front side (the left side in the same drawings), extending from the back side to the front side of the multi-function device 10. As such, the transport path 23 extends from the back side of the multi-function device 10 to the output tray 21, passing through the image recording unit 24 along the way. As such, the sheet stored in the sheet feed tray 20 is transported along the transport path 23 upward from below so as to U-turn, and is guided to the image recording unit 24. After the image is recorded on the sheet, it is outputted to the output tray 21.

As shown in FIG. 3, a sheet feed roller 25 is provided above the sheet feed tray 20. The sheet feed roller 25 separates the sheets stacked on the sheet feed tray 20 one by one, and feeds the sheets to the transport path 23. The sheet feed roller 25 is supported at a distal end of a sheet feed arm 26 via a shaft and the sheet feed arm 26 is adapted to move upward and downward so as to be capable of coming into and out of contact with the sheet feed tray 20. The sheet feed roller 25 is connected to a drive transmission unit 27 composed of a plurality of gears meshed with each other. A motor, not shown, is connected to the drive transmission unit 27, and a drive force of the motor is transmitted to the sheet feed roller 25 so as to rotate the sheet feed roller 25.

The sheet feed arm 26 is supported by a proximal end shaft 17, and is adapted to be capable of rotating about the proximal end shaft 17. Accordingly, the sheet feed arm 26 can be swung, using the proximal end shaft 17 as a pivot. The sheet feed arm 26 is urged toward the sheet feed tray 20 by a sheet feed clutch, such as a spring or the like (not shown), when the sheet feed tray 20 is mounted, and is flipped upward when the sheet feed tray 20 is removed. When the sheet feed arm 26 is turned downward, the sheet feed roller 25 comes into press contact with the surface of a sheet on the sheet feed tray 20. When the sheet feed roller 25 rotates in this state, a frictional force is generated between a roller surface of the sheet feed roller 25 and the sheet. This frictional force feeds the uppermost sheet to the inclined separation plate 22. The fed sheet is guided upward, in abutment with the inclined separation plate 22 at its leading edge, and is fed to the transport path 23. When the uppermost sheet is fed by the sheet feed roller 25, a sheet immediately below may begin to be fed at the same time due to friction or static electricity. However, the sheet below is held back by being brought into abutment with the inclined separation plate 22.

The transport path 23 is defined by an outer guide surface and an inner guide surface opposed to each other at a predetermined distance. In the multi-function device 10, the outer guide surface is defined by an inner wall surface of a frame of the printer 11, and the inner guide surface is defined by a surface of a guide member provided inside the frame. A transport roller 29, as shown in FIG. 3, may be provided at a position where the transport path 23 is curved. The transport roller 29 is provided so as to be rotatable about the direction of width of the transport path 23 (the direction perpendicular to the XY plane of FIG. 3) as an axis of rotation. The transport roller 29 is mounted in such a manner that a roller surface of the transport roller 29 is exposed from the outer guide surface or the inner guide surface. The transport roller 29 smoothly transports the sheet in contact with the guide surface, even at the position where the transport path 23 is curved.

Figure 4:
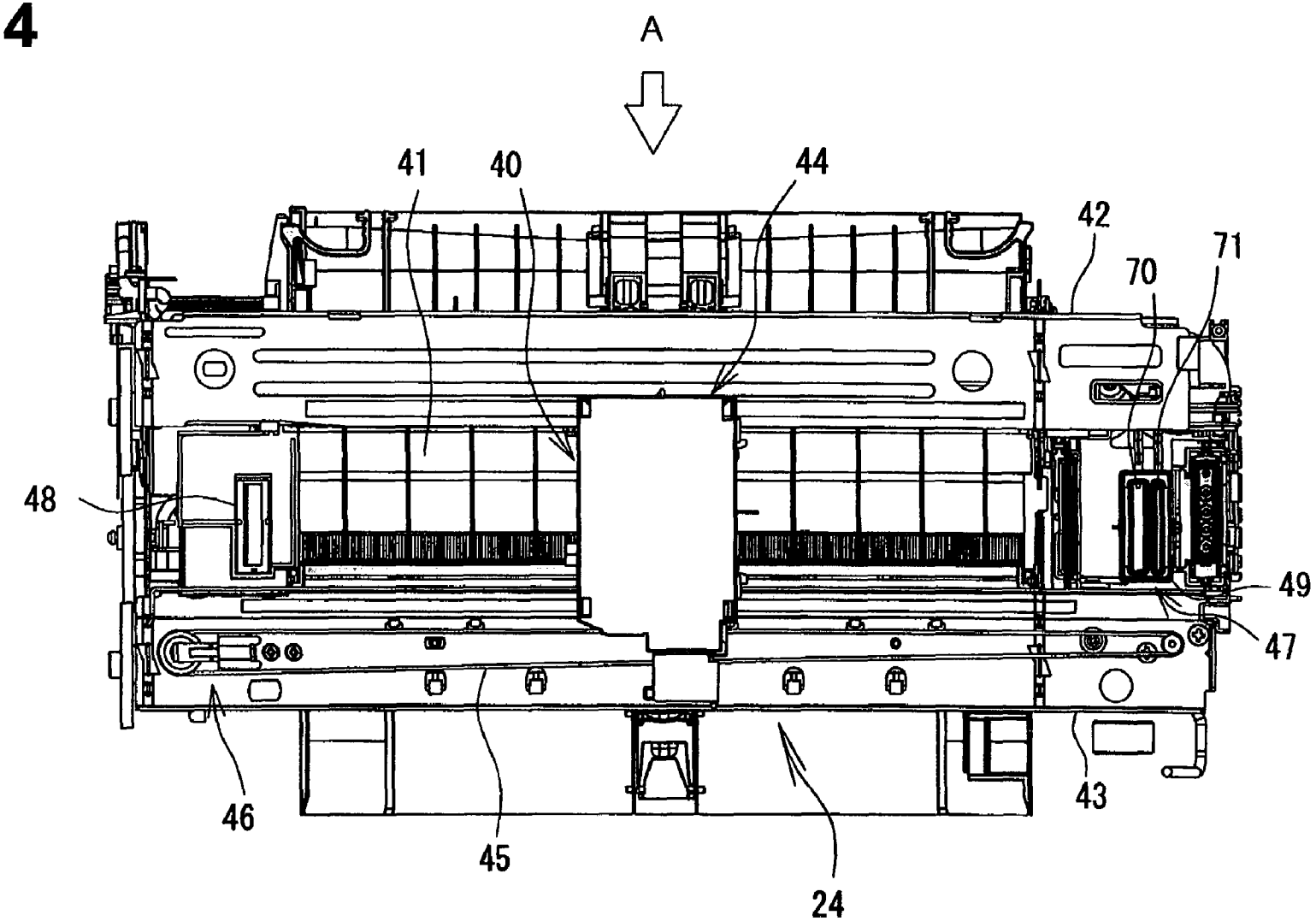
FIG. 4 is a plan view of the printer of the multi-function device according to the embodiment of the present invention.

Referring to FIG. 4, the image recording unit 24 is provided on the downstream side of the transport path (see FIG. 3), after the transport path 23 U-turns upward from below. As shown in FIG. 3 and FIG. 4, the image recording unit 24 is provided with an ink-jet printing head 40, which is slid in the main scanning direction (the direction perpendicular to the XY plane in FIG. 3, the left and right directions in FIG. 4). A platen 41 is provided parallel to the ink-jet printing head 40. The transported sheet is fed onto the platen 41. Ink cartridges (not shown) are installed in the multi-function device 10. The ink cartridges store ink in the respective colors cyan (C), magenta (M), yellow (Y), and black (K). The respective color inks are supplied to the ink-jet printing head 40 from the ink cartridges via conduits such as tubes.

While sliding in the main scanning direction, the ink-jet printing head 40 prints an image on the sheet, transported on the platen 41, by discharging ink droplets. As shown in FIG. 4, a pair of guide members 42, 43 are provided on the upper side of the transport path 23. The guide members 42, 43 are arranged at a predetermined distance in the sheet transport direction A, and extend in the widthwise direction of the transport path 23. The ink-jet printing head 40 is held by a carriage 44. The carriage 44 is supported by the guide members 42, 43 so as to be capable of sliding in the widthwise direction of the transport path 23. A belt driving unit 46 is provided on the downstream guide member 43. The belt driving unit 46 includes a timing belt 45 mounted to the carriage 44. The timing belt 45 is strained tightly in the widthwise direction of the transport path 23 in an endless manner, and is driven to rotate by a CR motor, not shown. When the timing belt 45 is driven, the carriage 44 is slid in the main scanning direction while being supported by the guide members 42, 43.

As shown in FIG. 3, a drive roller 55 and a presser roller 56 are provided on the upstream side of the transport path 23 (the upstream side of the ink-jet printing head 40). The drive roller 55 is adapted to be driven by an LF motor (not shown). The drive roller 55 and the presser roller 56 nip the sheet transported in the transport path 23. When the drive roller 55 is rotated, the sheet is fed to the downstream side of the transport path 23, and is placed on the platen 41. The transportation of the sheet is observed by a sheet transport encoder. The sheet transport encoder includes an encode disk, provided on the axis of rotation of the drive roller 55, as well as a photo sensor, for reading a pulse from the rotating encoder disk. Therefore, the transportation distance of the sheet is determined by the sheet transport encoder based on detection of the number of rotations of the drive roller 55.

An output roller 57 and a presser roller 58 are provided on the downstream side of the transport path 23 (the downstream side of the ink-jet printing head 40). The output roller 57 is adapted to be driven by the LF motor that rotates the drive roller 55. As such, the output roller 57 is driven synchronously with the drive roller 55 via an interlocking unit (not shown). The output roller 57 and the presser roller 58 nip the sheet on which the ink droplets are discharged. When the output roller 57 is rotated, the sheet is fed to the downstream side of the transport path 23. The transportation of the sheet in this case is also observed by the sheet transport encoder. The distance of transportation of the sheet is determined by the sheet transport encoder via the drive roller 55, based upon the number of rotations of the output roller 57.

The presser roller 56 is resiliently urged against the drive roller 55 so as to press by a predetermined pressing force. Therefore, when the sheet enters between the drive roller 55 and the presser roller 56, the presser roller 56 is drawn backward by an amount corresponding to the thickness of the sheet and nips the sheet in cooperation with the drive roller 55. In this manner, the rotational force of the drive roller 55 is reliably transmitted to the sheet. The presser roller 58 is also provided in the same manner with respect to the output roller 57. However, in this embodiment, since the presser roller 58 is brought into a press contact with the sheet after the image is recorded, a roller surface is formed into a spur shape so as not to deteriorate the image recorded on the sheet.

The sheet nipped between the drive roller 55 and the presser roller 56 is transported intermittently on the platen 41 by a predetermined line feed amount. The ink-jet printing head 40 is slid upon each line feed of the sheet, and records the image from the leading edge side of the sheet. The sheet on which the image is recorded is nipped on its leading end side by the output roller 57 and the presser roller 58. The sheet is intermittently transported by the predetermined line feed amount while being nipped on the leading edge side between the output roller 57 and the presser roller 58, and being nipped on the trailing end side between the drive roller 55 and the presser roller 56. While the sheet is being transported in this manner, the image is recorded by the ink-jet printing head 40. After printing the image on a predetermined area of the sheet, the output roller 57 continues to rotate, and the sheet nipped between the output roller 57 and the presser roller 58 is outputted to the output tray 21.

As shown in FIG. 4, a purging unit 47 and a waste ink tray 48 are disposed on both the left and right sides of the image recording unit 24, outside of the image printing area of the ink-jet printing head 40.

The purging unit 47 includes (1) a cap 49 for covering a nozzle surface of the ink-jet printing head 40, (2) supporting members 82, 83 arranged in the cap 49 (see FIG. 10 and FIG. 13), (3) a suction pump 60 (see FIG. 14) to be connected to the ink-jet printing head 40 via the cap 49, and (4) a shifting unit (not shown) for bringing the cap 49 into and out of contact with the nozzle surface of the ink-jet printing head 40. When the shifting unit is activated, the cap 49 seals the nozzle surface of the ink-jet printing head 40. When the suction pump 60 is activated, ink is sucked from the ink-jet printing head 40. The suction pump 60, which can be employed here, may be a pump unit in which air flows by crushing a flexible tube with a roller, or the like, in sequence. However, other known pumping units may be used as well.

The waste ink tray 48 has an opening on its upper side corresponding to the nozzle surface of the ink-jet printing head 40. The waste ink tray 48 traps ink discharged from the ink-jet printing head 40.

Figure 5:
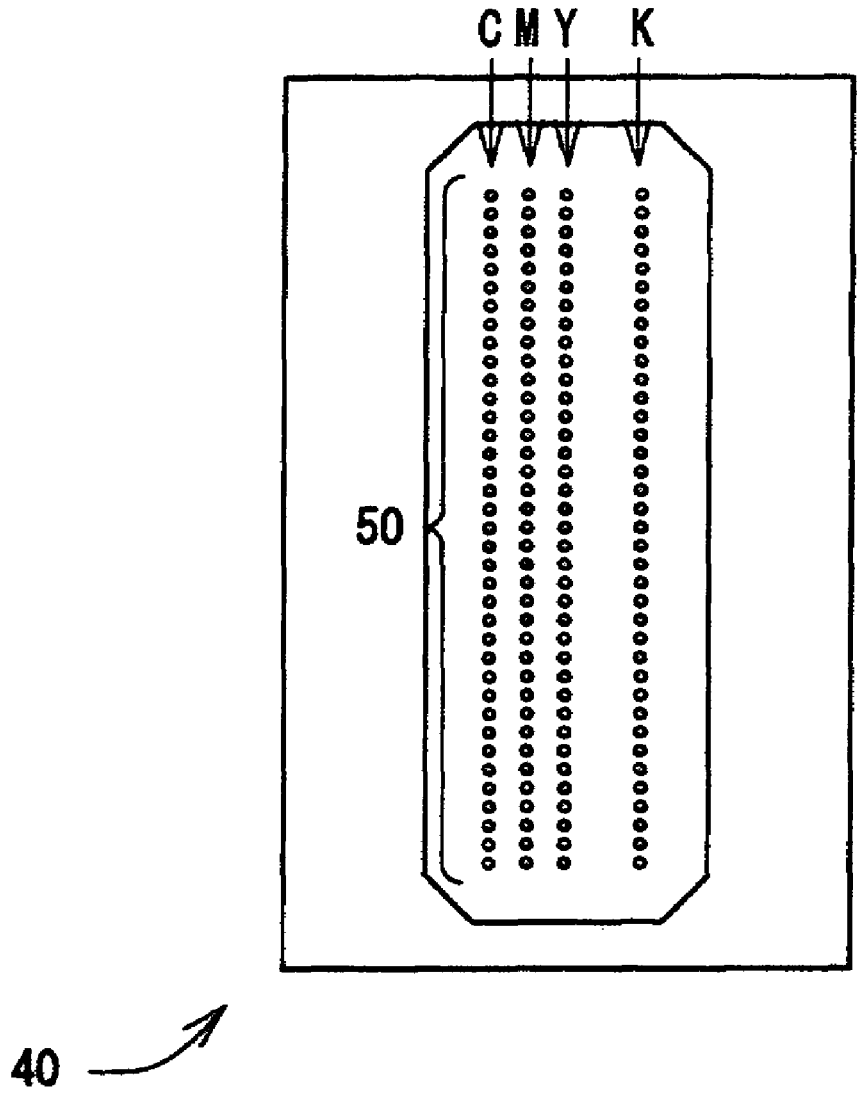
FIG. 5 is an enlarged drawing of a lower surface (nozzle surface) of an ink-jet printing head of the multi-function device according to the embodiment of the present invention.

As shown in FIG. 5, the ink-jet printing head 40 is provided with a plurality of nozzles 50. The respective nozzles 50 include ink discharge ports that open on the lower surface of the ink-jet printing head 40. These nozzles 50 are classified into groups corresponding to cyan (C), magenta (M), yellow (Y), and black (B) inks. The nozzles 50 corresponding to the respective color inks are arranged in the sheet transport direction. In this embodiment a row of nozzles 50 for discharging cyan (C) ink are arranged on the leftmost side along the transport direction A. Then, adjacently to the cyan (C) ink nozzle row, a row of nozzles 50 is arranged for discharging magenta (M) ink. Adjacent to the magenta (M) ink nozzle row, a row of nozzles for discharging yellow (Y) ink are also arranged in the transport direction. Next to them, a row of nozzles 50 for discharging black (K) ink are further provided in the transport direction A. As shown in FIG. 5, the nozzle rows are formed at predetermined intervals in four rows. The pitch, or number, of the nozzles 50 in the transport direction is set as needed according to the desired resolution, or the like, of the printing image. The number of rows of the nozzles 50 can be increased or decreased according to the number of the color inks.

Figure 6:
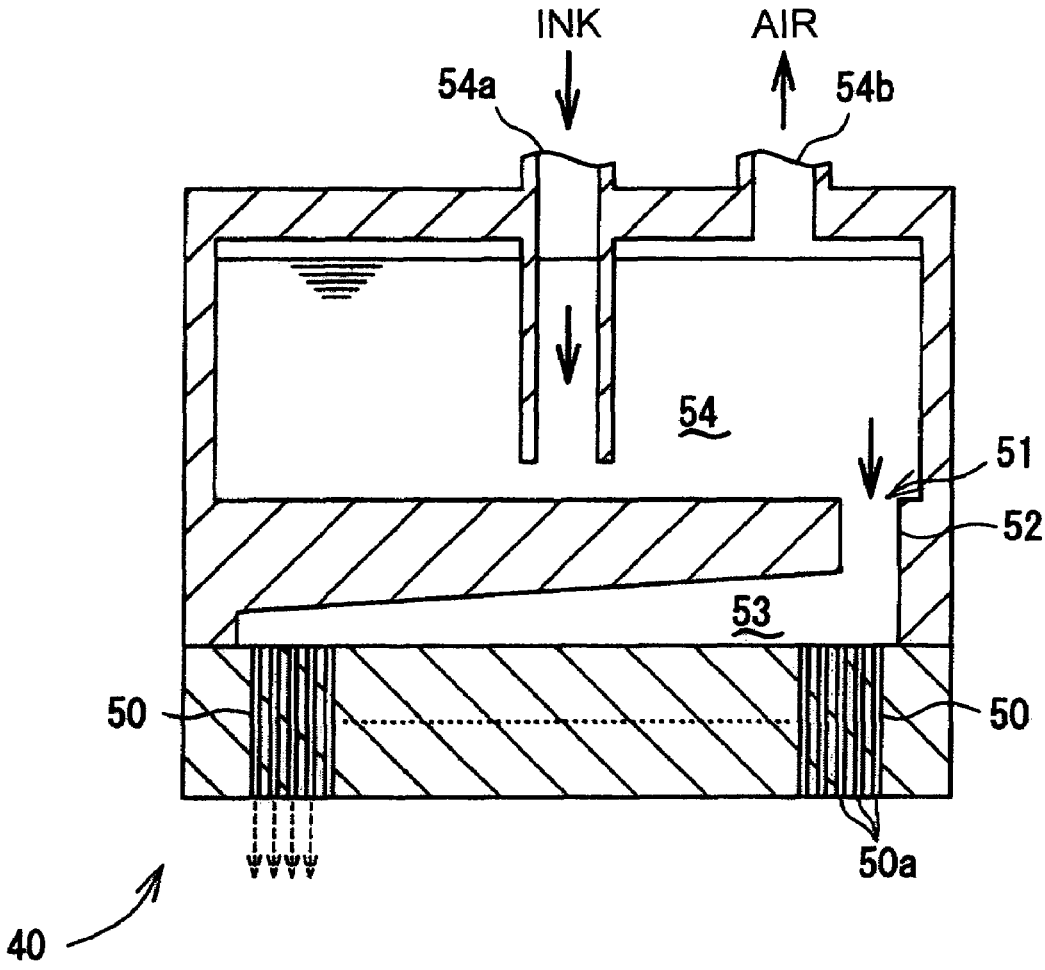
FIG. 6 is a schematic cross-sectional view of an internal structure of the ink-jet printing head of the multi-function device according to the embodiment of the present invention.

As shown in FIG. 6, the plurality of nozzles 50 is formed on the lower portion of the ink-jet printing head 40. In FIG. 6, the plurality of nozzles 50 corresponds to those for the cyan (C) ink. A manifold 51 is formed at the upper ends of the respective nozzles 50. A manifold 51 is formed for each of the respective color inks. The manifold 51 includes a supply tube 52 and a manifold chamber 53. Ink is supplied from the supply tube 52, and is distributed to the respective nozzles 50 through the manifold chamber 53.

A surface of the manifold chamber 53 opposing the respective nozzles 50 is inclined downward in the direction downstream of the ink flow. As such, the manifold chamber 53 is configured so that the cross-sectional area decreases in the direction downstream of the ink flow. In this embodiment, the side wall of the nozzle 50 is formed of a piezoelectric material. The nozzle 50 injects ink droplets by deformation of the piezoelectric material, and then discharges ink droplets from the ink discharge ports 50*a* in the same manner. Other known mechanisms can be employed for causing the ink droplets to be discharged from the nozzle 50.

A buffer tank 54 is disposed on the upstream side of the manifold 51. A buffer tank 54 is provided for each of the respective CMYK color inks, just as with the nozzles 50 and the manifolds 51. The buffer tank 54 communicates with the manifold chamber 53 through the supply tube 52. An ink tank (not shown) and an ink supply port 54*a* are connected by a conduit, such as a tube, so that ink is supplied from the ink tank to the buffer tank 54 by known means. In this manner, the ink is not supplied directly from the ink tank to the nozzles 50, but is stored in the buffer tank 54. Therefore, air bubbles generated in the ink in the conduit can be caught in the buffer tank 54. Accordingly, this design prevents air bubbles from entering into the nozzles 50. The air bubbles caught in the buffer tank 54 are removed by a pump unit (not shown) through an air bubble discharge port 54*b*.

Figure 7:
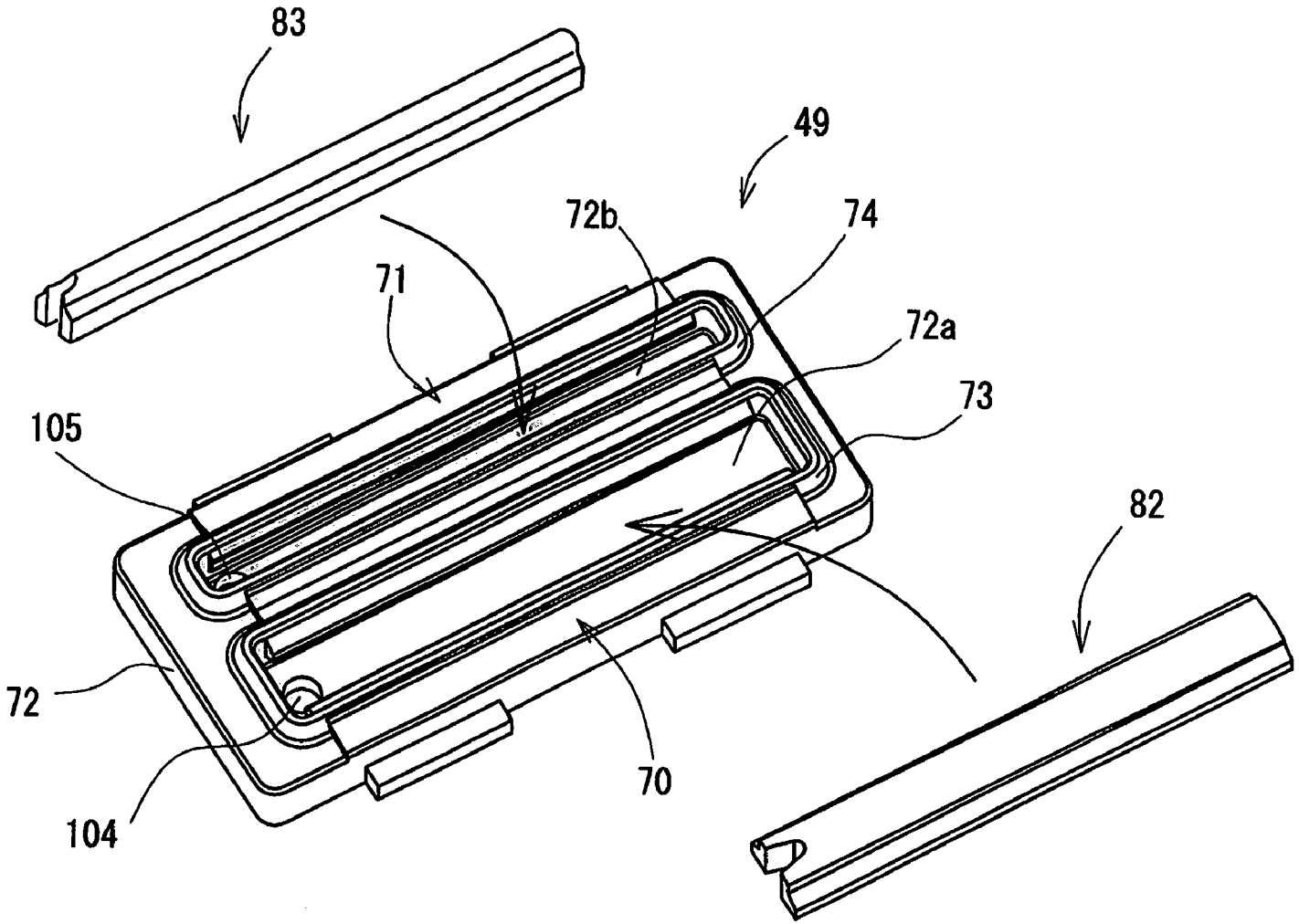
FIG. 7 is an enlarged exploded perspective view of a principal portion of a purging unit of the multi-function device according to the embodiment of the present invention.
Figure 8:
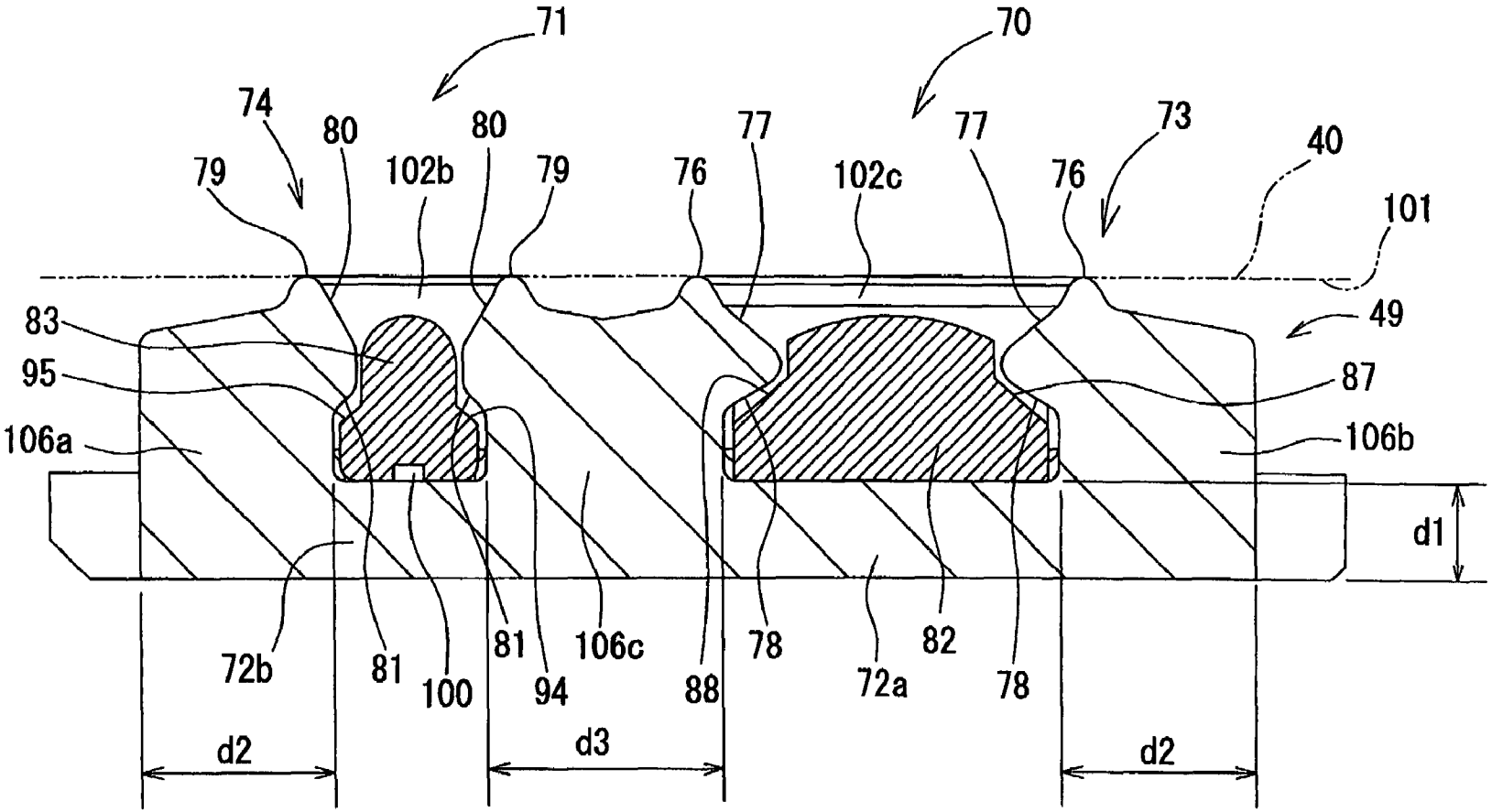
FIG. 8 is a cross-sectional view of a cap of the purging unit of the multi-function device according to the embodiment of the present invention.

Referring to FIG. 7 and FIG. 8, the cap 49 is formed of elastomer, such as butyl rubber, ethylene-propylene-diene ternary copolymer (EPDM), and so on. As shown in FIG. 7, the cap 49 is formed into a rectangular plate shape as a whole. The hardness of rubber which constitutes the cap 49 is 30 (Hardness A of durometer type under JIS (Japan Industrial Standard) 6253). The hardness of the rubber which constitutes the cap 49 can be set as needed within the range from 30 to 50 (Hardness A of durometer type under JIS 6253). The supporting members 82, 83, described later, are mounted to the cap 49. Since FIG. 7 is the exploded perspective view, the supporting members 82, 83 are shown at a position apart from the cap 49.

As shown in FIG. 4 and FIG. 8, in this embodiment, the cap 49 includes a color cap portion 70 and a black cap portion 71, which are formed integrally. The color cap portion 70 integrally seals the nozzles 50 (see FIG. 5) for discharging the respective color inks of cyan (C), magenta (M) and yellow (Y), and the black cap portion 71 seals only the nozzles 50 which discharge the black (K) ink. In this manner, since the color cap portion 70 and the black cap portion 71 are provided separately, the color inks and the black (K) ink are not mixed in the cap 49 when the cap 49 sucks ink from the ink-jet printing head 40. This prevents mixture of the inks in the nozzles 50.

As shown in FIG. 7 and FIG. 8, the cap 49 includes a flat plate shaped base 72 and lips 73, 74, which are provided on an upper surface of the base 72 (a surface opposing the ink-jet printing head 40 in FIG. 4). The lip 73 is provided corresponding to the color cap portion 70, and the lip 74 is provided corresponding to the black cap portion 71. In this embodiment, a portion of the base 72 corresponding to the lip 73 is referred to as a base 72*a*, and a portion of the base 72 corresponding to the lip 74 is referred to as a base 72*b*.

Figure 9:
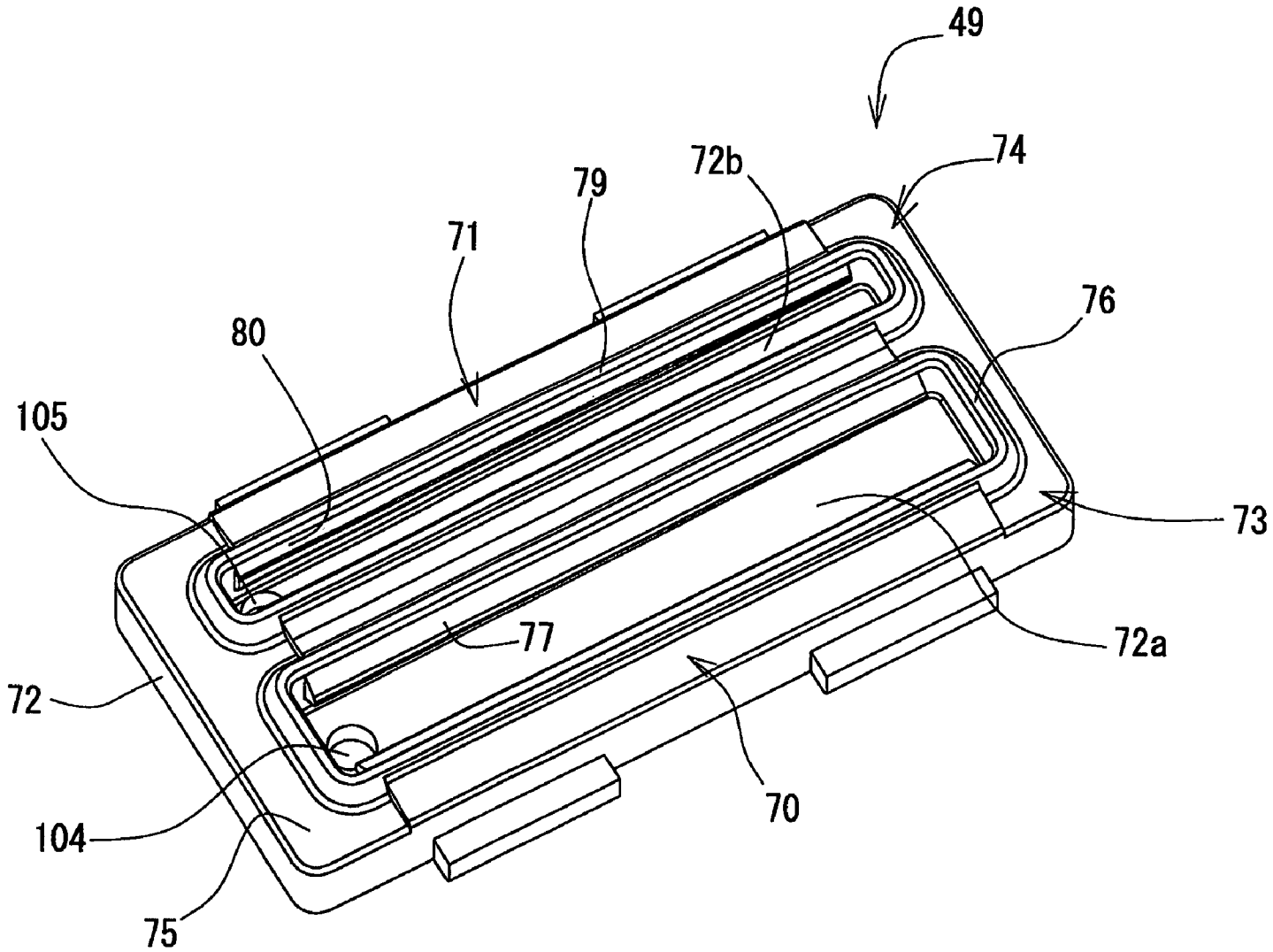
FIG. 9 is an enlarged perspective view of the cap of the purging unit of the multi-function device according to the embodiment of the present invention.

Referring to FIG. 9, the lip 73 is formed into a cylindrical shape, and is provided so as to project from the upper surface 75 of the base 72. A cross-section of this cylindrical shape, in the plane of FIG. 4, may be circular, elliptical, rectangular, or any other shape which comprises a continuous path with no end points. Since the lip 73 is formed into a cylindrical shape, the nozzles 50 for discharging the color inks are enclosed by the lip 73 when a distal end portion of the lip 73 is brought into abutment with the ink-jet printing head 40.

As shown in FIG. 8, the distal end portion of the lip 73 is formed into a V-shape in cross-section. More specifically, the lip 73 includes (1) a contact surface 76 which comes into abutment with the ink-jet printing head 40, (2) a first inclined surface 77 extending from the contact surface 76, and (3) a second inclined surface 78 extending from the first inclined surface 77. The first inclined surface 77 extends from a peripheral edge of the contact surface 76 inwardly of the lip 73, away from the ink-jet printing head 40 and toward the base 72*a*. The second inclined surface 78 extends from a peripheral edge of the first inclined surface 77 outwardly of the lip 73, away from the ink-jet printing head 40 and toward the base 72*a*. The second inclined surface 78 intersects with the first inclined surface 77 so as to form an acute angle.

The lip 74 is also formed into a cylindrical shape like the lip 73, and projects from the upper surface 75 of the base 72. Since the lip 74 is formed into the cylindrical shape, the nozzles 50 for discharging the black ink are enclosed by the lip 74 when a distal end portion of the lip 74 is brought into abutment with the ink-jet printing head 40. The lip 74 is also formed into a substantially V-shape in cross-section, and includes a contact surface 79 which comes into abutment with the ink-jet printing head 40, a first inclined surface 80 extending from the contact surface 79, and a second inclined surface 81 extending from the first inclined surface 80. The first inclined surface 80 extends from a peripheral edge of the contact surface 79 inwardly of the lip 74, away from the ink-jet printing head 40 toward the base 72*b*. The second inclined surface 81 extends from a peripheral edge of the first inclined surface 80 outwardly of the lip 74, away from the ink-jet printing head 40 toward the base 72*b*.

The thickness dimension d2 of both the side wall 106*a* of the lip 74, and the side wall 106*b*, of the lip 73 are set to be larger than the thickness dimension d1 of the base 72 (72*a*, 72*b*). More specifically, the dimension d1 is in the range of 1.0 to 2.5 mm, and the dimension d2 is in the range of 2.6 to 4.0 mm. The thickness dimension d3 of a boundary wall 106*c* that partitions the lip 73 and the lip 74 is also set to be larger than the thickness dimension d1 of the base 72 (72*a*, 72*b*). More specifically, the dimension d3 is in the range of 2.6 to 4.0 mm. As such, the bases 72*a*, 72*b* are formed to be thinner than the side walls 106*a*, 106*b* of the lips 73, 74, as well as the boundary wall 106*c*, and are sufficiently flexible.

Accordingly, the base 72*a* resiliently deforms with ease when the lip 73 comes into abutment with the ink-jet printing head 40 and the suction pump 60 is activated. Similarly, the base 72*b* resiliently deforms with ease when the lip 74 comes into abutment with the ink-jet printing head 40 and the suction pump 60 is activated. As described later, since the purging unit 47 is provided with a color switching unit 110 (see FIG. 14), the suction pump 60 can be activated separately for the lip 73 or the lip 74, or collectively for both lips 73,74.

Spaces 102*b*, 102*c* are defined between the ink-jet printing head 40 and the cap 49. When the suction pump 60 is activated, and the pressure in spaces 102*b*, 102*c* is lowered. The dimensions d1, d2, and d3 are set in such a manner that the bases 72*a*, 72*b* deform toward the spaces 102*b*, 102*c* when the suction pump 60 is activated, while the side walls 106*a*, 106*b* of the lips 73, 74 and the boundary wall 106*c* do not deform significantly. In this case, the dimensions d1, d2, and d3 are set based on (1) the pressure in the spaces 102*b*, 102*c* when the suction pump 60 is activated, (2) the inner peripheral surface areas of the side walls 106*a*, 106*b* and the boundary wall 106*c*, and (3) the hardness of the rubber which constitutes the cap 49. The effects and advantages of resilient deformation of the bases 72*a*, 72*b* by the operation of the suction pump 60 will be described later.

As shown in FIG. 9, a through hole 104 is formed on the base 72*a*, and a through hole 105 is formed on the base 72*b*. The through hole 104 is provided at a position corresponding to the bottom of the lip 73, and the through hole 105 is formed at a position corresponding to the bottom of the lip 74. The lips 73, 74 communicate with the suction pump 60 via the through holes 104, 105. Therefore, when the suction pump 60 is activated, air in the lips 73, 74 is sucked out through the through holes 104, 105.

Figure 11:
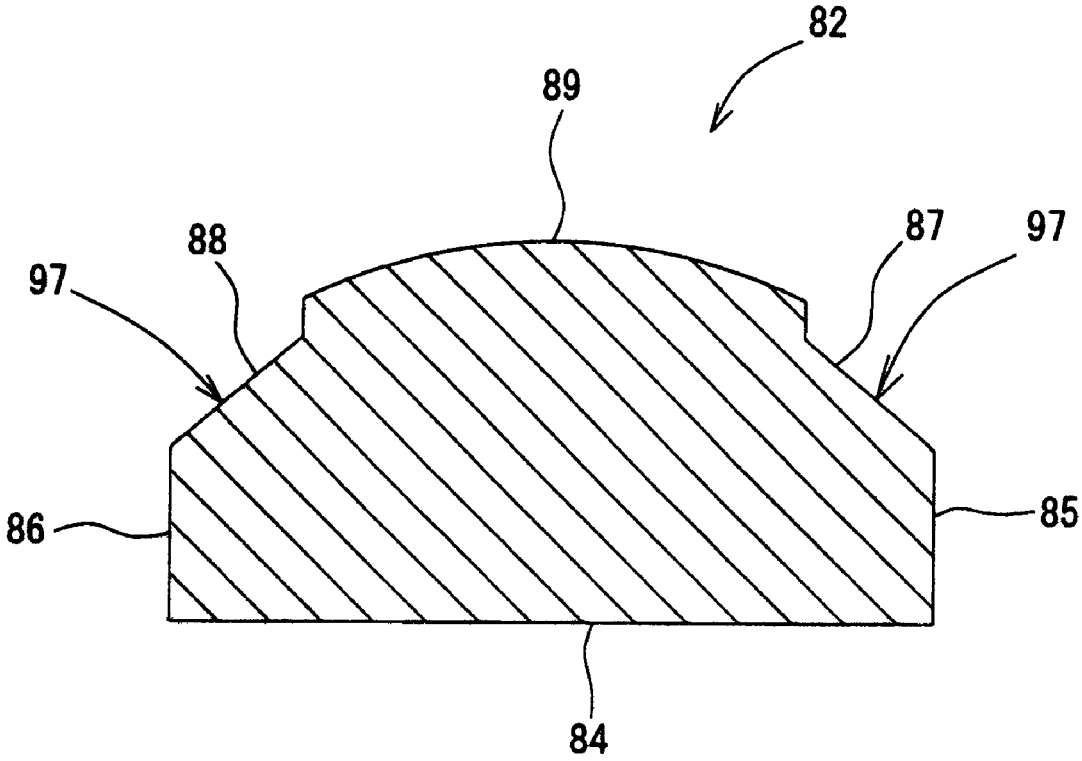
FIG. 11 is an enlarged cross-sectional view of the supporting member arranged in the cap of the purging unit of the multi-function device according to the embodiment of the present invention.
Figure 12:
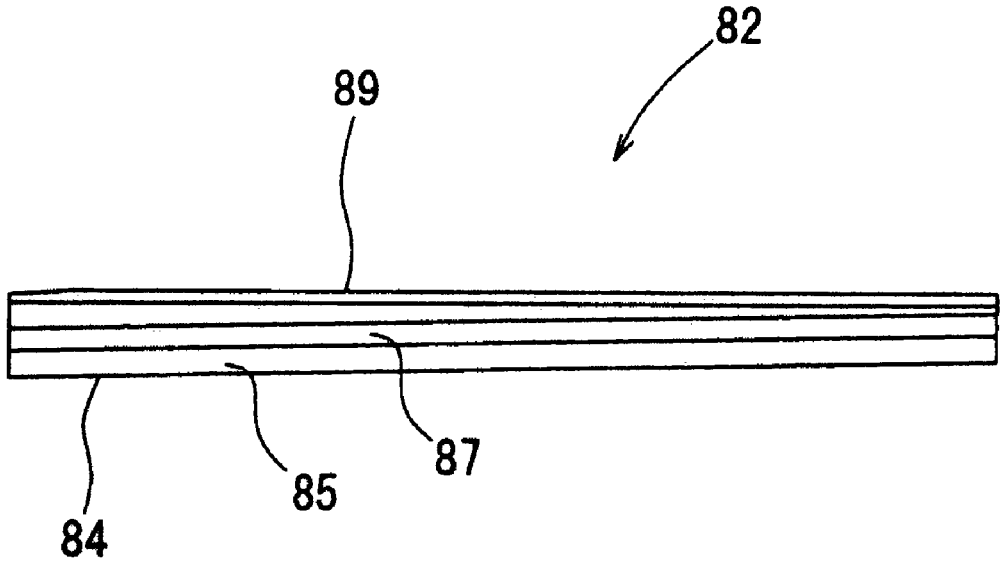
FIG. 12 is a side view of the supporting member arranged in the cap of the purging unit of the multi-function device according to the embodiment of the present invention.

As shown in FIG. 8, the supporting member 82 is fitted into the lip 73 of the color cap portion 70. As shown in FIG. 12, the supporting member 82 is formed into an elongated rod shape. Examples of the material from which the supporting member 82 is formed include resin, rubber, and metal. In this embodiment, a slow taper is formed on an upper surface of the supporting member 82. As shown in FIG. 11, the supporting member 82 includes a bottom surface 84, a pair of side walls 85, 86 extending from both ends of the bottom surface 84 upward, a pair of abutment portions 87, 88 continuing from the respective side walls 85, 86, and a crown portion 89 which connects the abutment portions 87, 88. Surfaces of the abutment portions 87, 88 constitute shoulder surfaces 97. The shoulder surface 97 abuts against the second inclined surface 78 of the lip 73. The effects and advantages of the abutment and support of the shoulder surface 97 with respect to the second inclined surface 78 will be described later.

Figure 10:
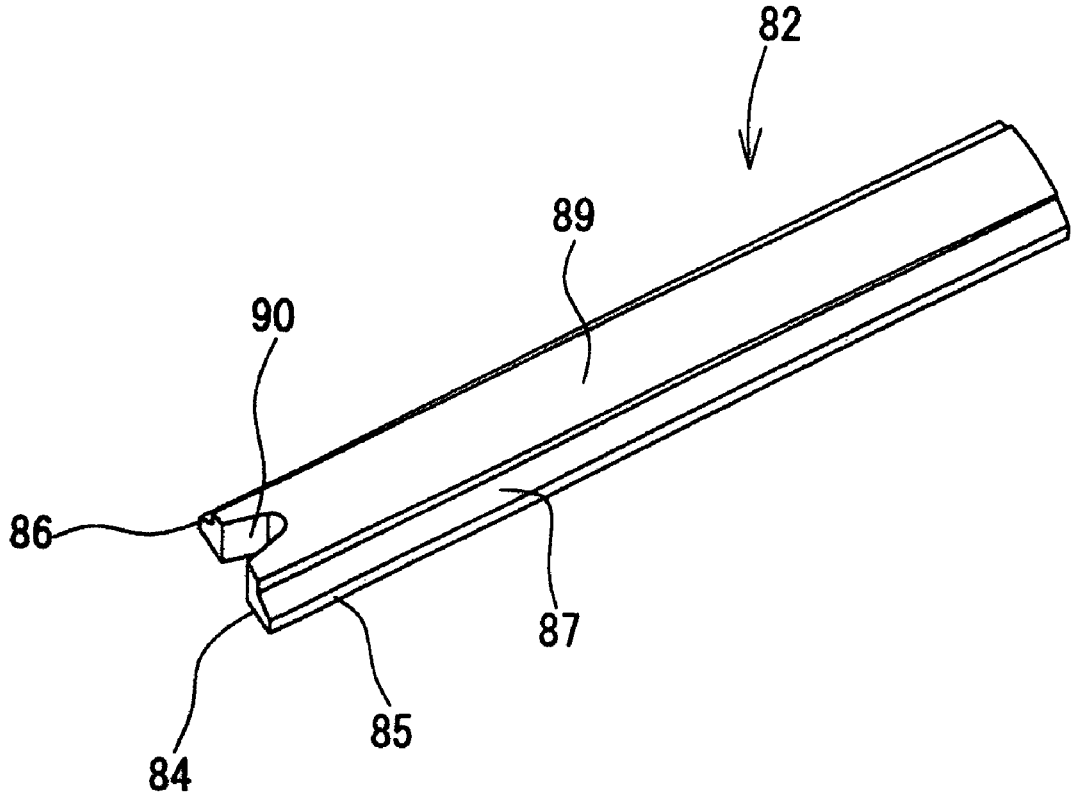
FIG. 10 is a perspective view of a supporting member arranged in the cap of the purging unit of the multi-function device according to the embodiment of the present invention.

In this embodiment, as shown in FIG. 10, a V-shaped groove 90 is formed at one end portion of the supporting member 82. Accordingly, a negative pressure acts upon the entire lip 73 uniformly when the suction pump 60 is activated and the supporting member 82 is fitted into the lip 73. Consequently, ink is sucked from the upper and lower sides of the supporting member 82. Another groove extending in the longitudinal direction may be provided on the bottom surface 84 of the supporting member 82.

Figure 13:
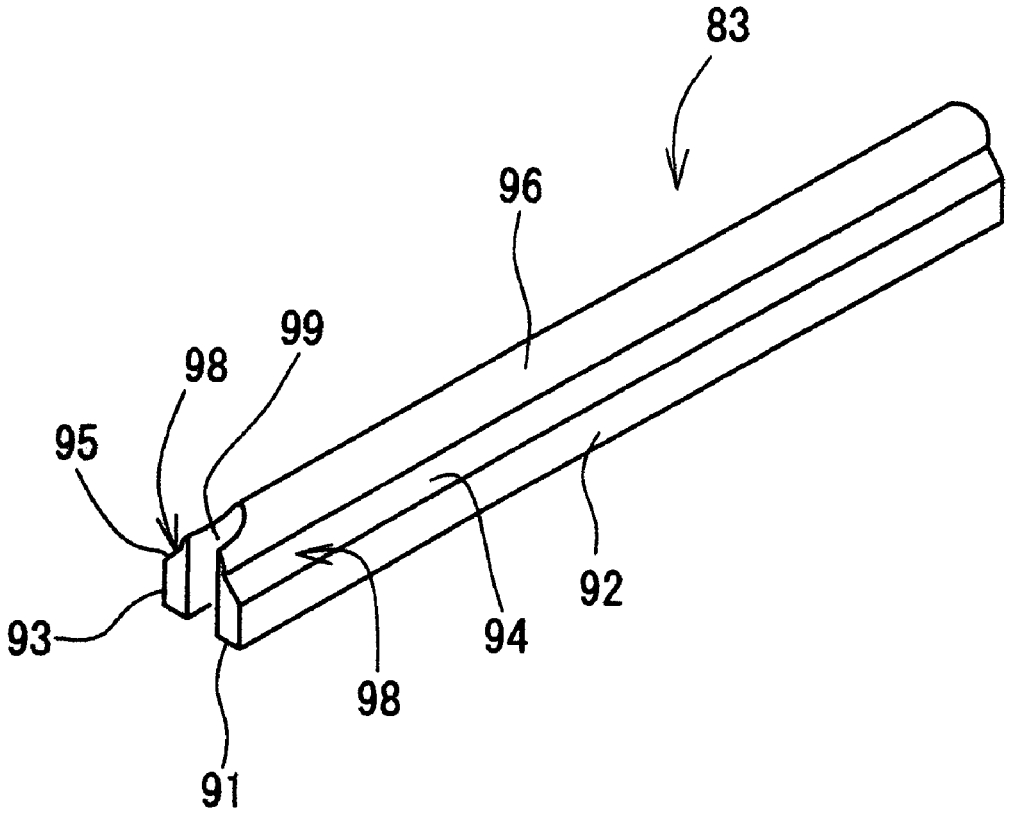
FIG. 13 is a perspective view of the supporting member arranged in the cap of the purging unit of the multi-function device according to the embodiment of the present invention.

As shown in FIG. 8, the supporting member 83 is fitted into the lip 74 of the black cap portion 71. The supporting member 83 is formed into an elongated rod shape. Examples of material from which the supporting member 83 may be formed include resin, rubber, and metal. In this embodiment, as with supporting member 82, a slow taper is formed on an upper surface of the supporting member 83. As shown in FIG. 8, the supporting member 83 is fitted into the lip 74. As shown in FIG. 13, the supporting member 83 includes a bottom surface 91, a pair of side walls 92, 93 extending from both ends of the bottom surface 91 upward, a pair of abutment portions 94, 95 continuing from the respective side walls 92, 93, and a crown portion 96 which connects the abutment portions 94, 95. Surfaces of the abutment portions 94, 95 constitute the shoulder surfaces 98. This shoulder surface 98 comes into abutment with the second inclined surface 81 of the lip 74. The effects and advantages of the abutment and support of the shoulder surface 98 with respect to the second inclined surface 81 will be described later.

In this embodiment, a V-shaped groove 99 is formed on one end portion of the supporting member 83. In addition, as shown in FIG. 8, a groove 100 extending in the longitudinal direction is provided on the bottom surface 91 of the supporting member 83. Accordingly, a negative pressure acts upon the entire lip 74 uniformly when the suction pump 60 is activated and the supporting member 83 is fitted into the lip 74. Consequently, ink is sucked from the upper and lower sides of the supporting member 83.

Figure 14:
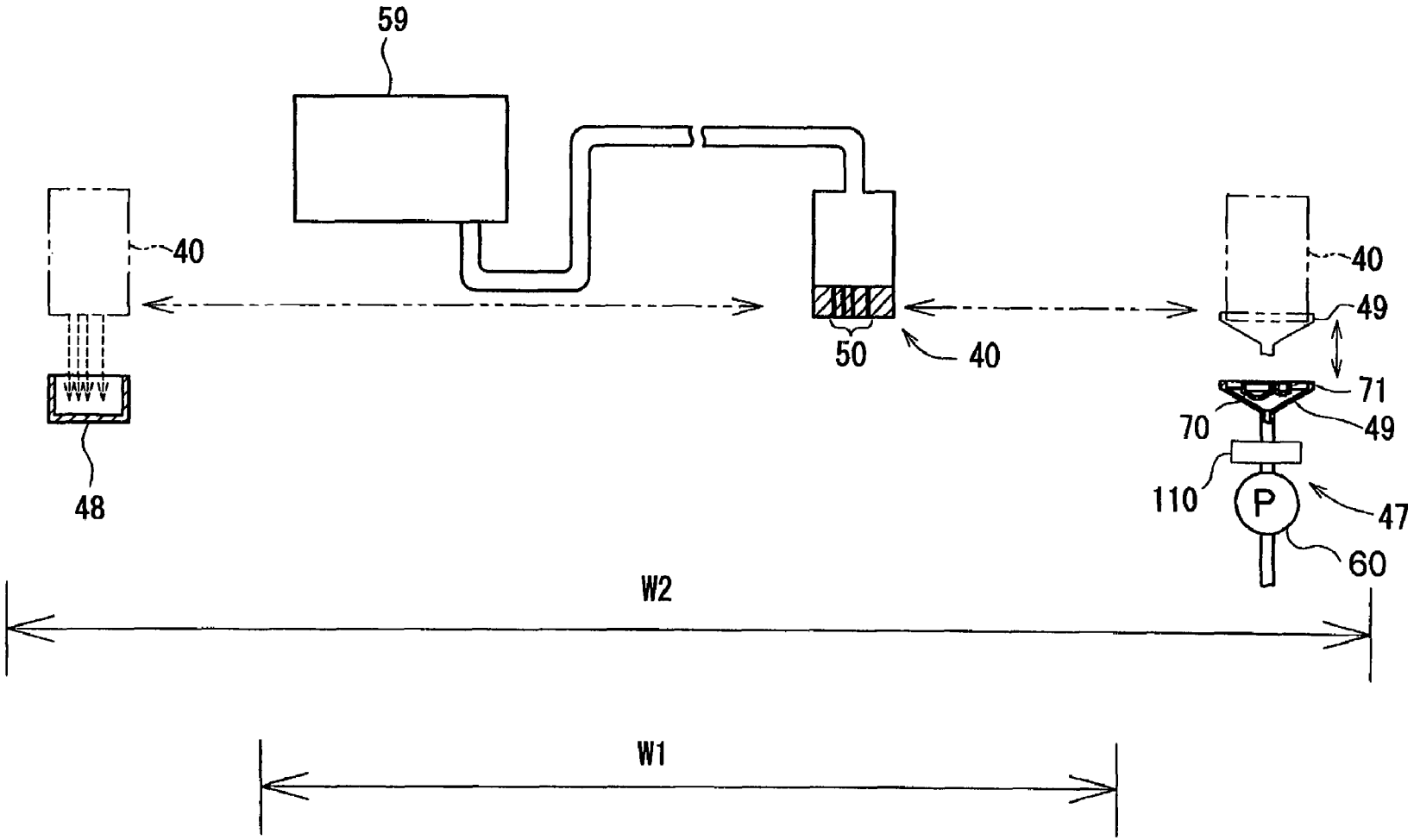
FIG. 14 is a schematic diagram showing an ink supply path from the ink tank to the ink-jet printing head, and an operating position of the ink-jet printing head of the multi-function device according to the embodiment of the present invention.

Referring to FIG. 14 and FIG. 6, ink is supplied from the ink tank 59 through a conduit to the ink-jet printing head 40 and is stored in the buffer tank 54. The ink is distributed to the nozzles 50 from the supply tube 52 through the manifold chamber 53, and is discharged as ink droplets from the ink discharge ports 50*a* of the respective nozzles 50. To print an image, a sheet is transported under the ink-jet printing head 40. The ink-jet printing head 40 then slides in an image printing range W1 while discharging the ink droplets of the respective color inks on a sheet.

As shown in FIG. 14, the purging unit 47 and the waste ink tray 48 are arranged out of the image printing range W1 of the ink-jet printing head 40. The purging unit 47 and the waste ink tray 48 are each located on opposite ends of a slidable range W2. As described above, the purging unit 47 sucks and removes air bubbles or foreign substances from the nozzles 50 of the ink-jet printing heads 40. To purge the ink-jet printing head, the ink-jet printing head 40 is moved to a right end of the slidable range W2, and the cap 49 is moved upward by the shifting unit of the purging unit 47. As shown in FIG. 8, the cap 49 comes into tight contact with a lower surface 101 of the ink-jet printing head 40, and encloses the nozzles 50.

At this time, the nozzles 50 for discharging black (K) ink are enclosed by the black cap portion 71, and the nozzles 50 for discharging color (CMY) inks are enclosed by the color cap portion 70. Accordingly, a space 102*b* is defined between the ink-jet printing head 40 and the black cap portion 71, and the space 102*c* is defined between the ink-jet printing head 40 and the color cap portion 70. When the suction pump 60 is activated, the pressure in the spaces 102*b*, 102*c* is lowered, whereby the ink is sucked from the nozzles 50 of the ink-jet printing head 40.

The purging unit 47 in this embodiment includes a color switching unit 110. The color switching unit 110 connects the suction pump 60 to the space 102*b* or the space 102*c*. Therefore, when the color switching unit 110 is activated, the black (K) ink or the color (CMY) inks are separately sucked. In addition, the color switching unit 110 may be set so that the black (K) ink and the color (CMY) inks are sucked simultaneously when the suction pump 60 is activated. Furthermore, the color switching unit 110 may be omitted as a matter of course.

The waste ink tray 48 (see FIG. 14) receives ink discharged from the ink-jet printing head 40 by an idling operation, which is called "flashing". As shown in FIG. 15, when the flashing is carried out, the ink-jet printing head 40 is moved to a left end of the slidable range W2. The respective color inks are then discharged toward the waste ink tray 48 by the idling operation. The layout of the purging unit 47 and the waste ink tray 48 is not specifically limited. Accordingly, the purging unit 47 may be located on left end of the slidable range W2, while the waste ink tray 48 may be located on right end of the slidable range W2. In addition, the purging unit 47 and the waste ink tray 48 may both be arranged on the same side of the slidable range W2.

In this embodiment, the purging unit 47 is activated at the initiation of usage (when the power is turned on) or when the nozzles 50 of the ink-jet printing head 40 become clogged. The purging unit 47 may also be regularly activated during image printing. Upon activation of the purging unit 47, ink is sucked from the ink-jet printing head 40 as described above, and increases in viscosity of ink in the nozzles 50 are prevented.

Figure 15A:
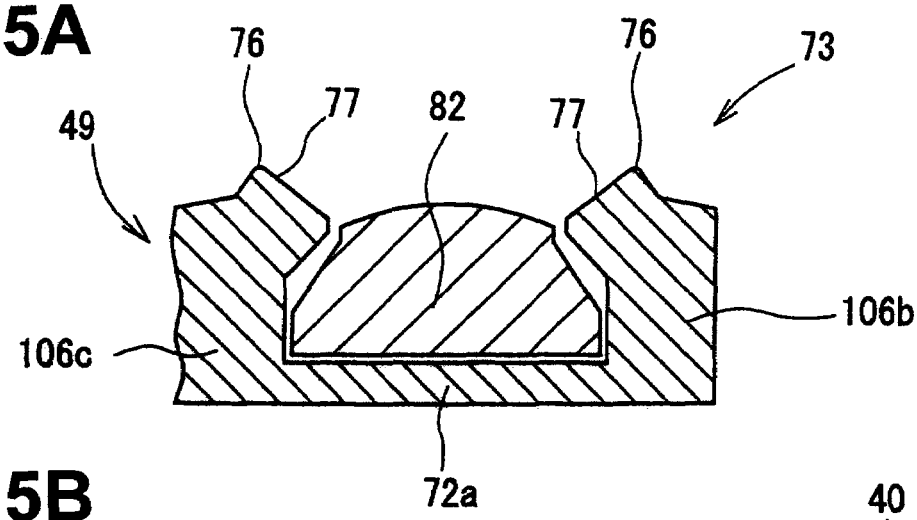
FIGS. 15A-15C are schematic diagrams showing a relative positional relation between the cap and the ink-jet printing head when the purging unit of the multi-function device according to the embodiment of the present invention is activated.
Figure 15B:
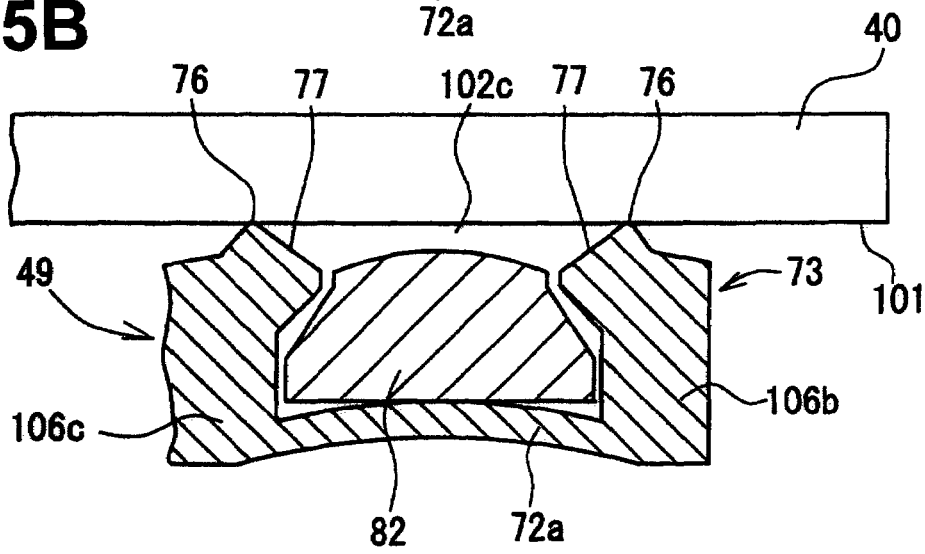
Figure 15C:
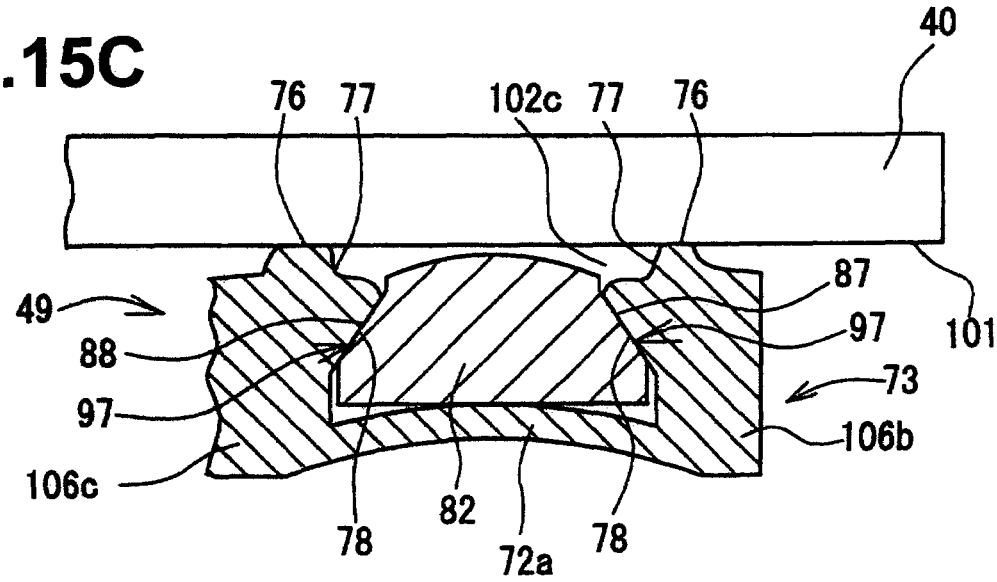

In FIGS. 15A-15C, only the lip 73 of the cap 49 is shown in the drawing. However, the relative positional relation between the lip 74 and the ink-jet printing head 40 is also the same. Before the activation of the purging unit 47, the supporting member 82 is fitted into the lip 73 as shown in FIG. 15A. Although not shown in the drawing, the supporting member 83 is also fitted into the lip 74 in the same manner (see FIG. 8). When the purging unit 47 is activated, the cap 49 is moved and, as shown in FIG. 15B, the lip 73 comes into abutment with the lower surface 101 of the ink-jet printing head 40. Accordingly, the lip 73 encloses and covers the nozzles 50. In addition, when the suction pump 60 is activated, the pressure in the space 102*c* becomes negative with respect to the pressure outside the space 102*c*. As a result, the base 72*a* of the cap 49 deforms so as to project inwardly of the lip 73 as shown in FIG. 15B. Similarly, the base 72*b* of the lip 74 deforms in the same manner when the pressure in space 102*b* becomes negative.

In association with the operation of the suction pump 60, the pressure in the space 102*c* is lowered to a predetermined negative pressure and, accordingly, the base 72*a* projects inwardly of the lip 73 as shown in FIG. 15C. Deformed in this manner, the base 72*a* moves the supporting member 82 toward the distal end side of the lip 73 (the upper side in the drawing). The abutment portions 87, 88 of the supporting member 82 come into abutment with the inner side of the distal end portion of the lip 73. Accordingly, the lip 73 is supported by the supporting member 82 from below. In the same manner, the abutment portions 94, 95 of the supporting member 83 come into abutment with the inner side of the distal end portion of the lip 74 (see FIG. 8). Accordingly, the lip 74 is supported by the supporting member 83 from below. In this way, the supporting members 82, 83 can prevent the lips 73, 74 from bending and falling inward due to the negative pressure in the spaces 102*b* and 102*c*. Therefore, the contact state between the lips 73, 74 and the ink-jet printing head 40 can be reliably maintained.

Since the supporting members 82, 83 support the lips 73, 74, the contact state between the lips 73, 74 and the ink-jet printing head 40 is maintained and the possibility of the formation of a gap between the lips 73, 74 and the ink-jet printing head 40 is eliminated. This is the case even when the lips 73, 74 have significantly flexible structures, as well as when the suction pump 60 significantly reduces the pressure in the cap 49. Therefore, the nozzles 50 of the ink-jet printing head 40 are hermetically enclosed reliably by the cap 49, and the ink is reliably sucked from the nozzle 50 by the purging unit 47. Consequently, even when the ink-jet printing head 40 is upsized, the purging unit 47 functions desirably, and defective discharge of the ink droplets of the ink-jet printing head 40 can reliably be prevented.

In particular, in the multi-function device 10 according to this embodiment, the base 72 and the lips 73, 74 are formed integrally of rubber, such that the cap 49 is configured as a single part. Therefore, the number of parts of the purging unit 47 is reduced, decreasing the manufacturing cost. In addition, the manufacturing cost is also decreased because the structure for moving the supporting members 82, 83 is very simple.

In addition, the distal end portions of the lips 73, 74 are formed having a V-shaped cross-section, as shown in FIG. 8 and FIG. 15(*b*), and the extremities of the distal end portions of the lips 73, 74 project inwardly of their respective lips 73, 74.

When the pressure in the spaces 102*b*, 102*c* becomes negative, the distal end portions of the lips 73, 74 tend to fall inwardly. When this is about to occur, the shoulder surface 97 of the supporting member 82 abuts against the second inclined surface 78 of the lip 73, so that the distal end portion of the lip 73 is supported by the supporting member 82. The lip 74 is also supported by the supporting member 83 in the same manner. The supporting members 82, 83 are moved by the deformation of the base 72, and support the distal end portions of the lips 73, 74 as described above. As such, the purging unit 47 according to this embodiment reliably maintains a state of abutment between the lips 73, 74 and the ink-jet printing head 40.

The present invention can be applied to an ink-jet printing device provided with a purging unit or a multi-function device.

Also, an ink-jet printing device according to the present invention may include an ink-jet printing head, for printing an image by discharging ink droplets from a number of nozzles onto a recording medium, and a purging unit, for sucking ink from the nozzles. The purging unit includes (1) a cap having a flat plate shaped base and a cylindrical lip that extends upright from the base, (2) a suction pump for lowering the pressure in a space defined between the ink-jet printing head and the cap when the lip is in abutment with the ink-jet printing head, and (3) a supporting member disposed in the cap and capable of supporting the lip from the inside of the cap. The lip hermetically encloses the nozzles when a distal end portion of the lip abuts the ink-jet printing head. At least a portion of the base that corresponds to the inner side of the lip is flexible enough to be deformed so as to project inwardly of the lip when the pressure in the space is lowered. The supporting member includes an abutment portion that abuts against the inner side of the distal end portion of the lip when the base deforms.

In this ink-jet printing device, the purging unit is activated regularly. Accordingly, increases in viscosity of ink in the nozzle of the ink-jet printing head are prevented. More specifically, the cap is brought into abutment with the ink-jet printing head and the lip of the cap encloses and covers the nozzles provided on the ink-jet printing head. In this case, the cap may be configured in such a manner that a single lip covers all the nozzles. Alternatively, multiple caps may be provided. Such an example would include one lip for covering only the nozzles corresponding to black ink and another lip for covering nozzles corresponding to other color inks.

When the suction pump is activated while the lip covers the nozzles, the pressure in the cap is lowered. Accordingly, the pressure in the space defined between the ink-jet printing head and the cap becomes negative, and ink is sucked from the nozzles. At this time, the base of the cap deforms so as to project inwardly of the lip. The deformation of the base causes the supporting member to be moved toward the distal end portion of the lip. The abutment portion of the supporting member comes into abutment against the inner side of the distal end portion of the lip, thereby supporting the distal end portion of the lip. As a result, the supporting member can prevent deformation, even when the lip would otherwise bend and fall inwardly because of the negative pressure in the space. Hence, the contact state between the lip and the ink-jet printing head can be reliably maintained.

In this manner, the seal between the lip and the ink jet printing head is maintained, even when the lip has a structure having significant flexibility or when the suction pump reduces the pressure in the cap significantly. Therefore, the nozzles of the ink-jet printing head is hermetically enclosed by the cap reliably, and ink is reliably sucked from the nozzles by the purging unit.

Preferably, the base and the lip are integrally formed of rubber. In addition, the portion of the base corresponding to the inner side of the lip is preferably formed to be thinner than the lip itself, so as to be capable of being deformed easily in comparison with the lip when the pressure in the space is lowered.

Since the base and the lip are integrally formed of rubber, the cap is configured as a single part. Therefore, the number of parts is reduced, decreasing the manufacturing cost. In addition, the manufacturing cost is also decreased because the structure for moving the supporting member is very simple.

Preferably, the distal end portion of the lip is formed into a V-shape in cross-section and has (1) a contact surface that comes into abutment with the ink-jet printing head, (2) a first inclined surface extending from the contact surface obliquely inwardly of the lip, and (3) a second inclined surface contiguous to the first inclined surface, extending outwardly of the lip toward the base at an acute angle to the first inclined surface. Preferably, the abutment portion of the supporting member is formed with a shoulder surface that comes into abutment with the second inclined surface to support the second inclined surface.

In this case, the distal end portion of the lip is formed into a V-shape in cross-section, and the extremity of the distal end portion projects inwardly of the lip. When the contact surface of the lip comes into abutment with the ink-jet printing head, and the suction pump is activated, the distal end portion of the lip tends to fall inwardly since the pressure in the cap becomes negative. When this is about to occur, the shoulder surface of the supporting member abuts the second inclined surface of the distal end portion of the lip, so that the distal end portion of the lip is supported. Then, the supporting member is moved by the deformation of the base as described above, preventing the distal end portion of the lip from bending inwardly. Thus, the distal end portion of the lip is reliably brought into abutment with the ink-jet printing head.

Since the cap of the present invention can enclose the nozzles of the ink-jet printing head hermetically and reliably, the purging unit functions desirably and ink is reliably sucked from the ink-jet printing head. Therefore, clogging of the nozzles can be prevented reliably irrespective of the frequency of usage of the ink-jet printing device, ensuring desirable discharge of the ink droplets.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. An ink-jet printing device comprising:

an ink-jet printing head for printing an image by discharging ink droplets from a number of nozzles onto a recording medium; and a purging unit for sucking ink from the nozzles;

the purging unit comprising:

a cap having (1) a flat, plate shaped base, and (2) a cylindrical lip that extends upright from the base;

a suction pump for lowering a pressure in a space defined between the ink-jet printing head and the cap when the lip of the cap is in abutment with the ink-jet printing head; and a supporting member disposed in the cap and capable of supporting the lip from the inside of the cap;

wherein the lip hermetically encloses the nozzles when a distal end portion of the lip abuts the ink-jet printing head;

wherein at least a portion of the base corresponding to an inner side of the lip is flexible enough to be deformed so as to project inwardly of the lip when the pressure in the space is lowered, and wherein the supporting member comprises an abutment portion, the abutment portion abutting the inner side of the distal end portion of the lip when the base deforms.

2. The ink-jet printing device according to claim 1;

wherein the distal end portion of the lip has a V-shaped cross section;

wherein the distal end portion has (1) a contact surface that comes into abutment with the ink-jet printing head, (2) a first inclined surface extending away from the contact surface inwardly of the lip, and (3) a second inclined surface, contiguous to the first inclined surface, extending outwardly of the lip toward the base at an acute angle to the first inclined surface; and wherein the abutment portion of the supporting member is formed with a shoulder surface that comes into abutment with the second inclined surface so as to support the second inclined surface.

3. The ink-jet printing device according to claim 1;

wherein the base and the lip are integrally formed of rubber, and wherein at least the portion of the base corresponding to the inner side of the lip is formed to be thinner than the lip itself, so as to be capable of being deformed easily in comparison with the lip when the pressure in the space is lowered.

4. The ink-jet printing device according to claim 3;

wherein the distal end portion of the lip has a V-shaped cross section;

wherein the distal end portion has (1) a contact surface that comes into abutment with the ink-jet printing head, (2) a first inclined surface extending away from the contact surface inwardly of the lip, and (3) a second inclined surface, contiguous to the first inclined surface, extending outwardly of the lip toward the base at an acute angle to the first inclined surface; and wherein the abutment portion of the supporting member is formed with a shoulder surface that comes into abutment with the second inclined surface so as to support the second inclined surface.

5. The ink-jet printing device according to claim 1, wherein:

the number of nozzles include a first row of nozzles and a second row of nozzles;

the cap of the purging unit has a first cap portion and a second cap portion formed on the base, each cap portion having a cylindrical lip that extends upright from the base;

the suction pump of the purging unit lowers the pressure in a first space, defined between the ink-jet printing head and the first cap portion, when the lip of the first cap portion is in abutment with the ink-jet printing head;

the suction pump of the purging unit lowers the pressure in a second space, defined between the ink-jet printing head and the second cap portion, when the lip of the second cap portion is in abutment with the ink-jet printing head;

the purging unit comprises (1) a first supporting member disposed in the first cap portion and (2) a second supporting member disposed in the second cap portion;

the lip of the first cap portion hermetically encloses the first row of nozzles when a distal end portion of the lip of the first cap portion abuts the ink-jet printing head;

the lip of the second cap portion hermetically encloses the second row of nozzles when a distal end portion of the lip of the second cap portion abuts the ink-jet printing head;

a first portion of the base corresponding to the inner side of the lip of the first cap portion is flexible enough to be deformed so as to project inwardly of the lip of the first cap portion when the pressure in the first space is lowered;

a second portion of the base corresponding to the inner side of the lip of the second cap portion is flexible enough to be deformed so as to project inwardly of the lip of the second cap portion when the pressure in the second space is lowered;

when the first base portion deforms, the abutment portion of the first supporting member abuts the inner side of the distal end portion of the lip of the first cap portion; and when the second base portion deforms, the abutment portion of the second supporting member abuts the inner side of the distal end portion of the lip of the second cap portion.

6. The ink-jet printing device according to claim 5, wherein, the lip of the first cap portion is formed by (1) one of two opposite side walls and (2) a boundary wall disposed between the opposite side walls;

the lip of the second cap portion is formed by (1) the other of the two opposite side walls and (2) the boundary wall; and the two opposite side walls and the boundary wall extend upright from the base and the boundary wall partitions the lip of the first cap portion and the lip of the second cap portion.

7. The ink-jet printing device according to claim 6;

wherein a thickness of each of the opposite side walls and a thickness of the boundary wall are larger than a thickness of the base.

8. The ink-jet printing device according to claim 5;

wherein the first row of nozzles are used for discharging a black ink, and the second row of nozzles are used for discharging a color ink other than the black ink.

9. The ink-jet printing device according to claim 1, wherein:

the supporting member includes (1) a bottom surface to be opposed to the base when the supporting member is disposed in the cap, (2) a pair of side walls extending upright from the bottom surface, and (3) a pair of abutment portions extending from the side walls; and the pair of abutment portions abut the inner side of the distal end portion of the lip when the base deforms to push the bottom surface of the supporting member.

10. The ink-jet printing device according to claim 1;

wherein the base is formed with a through hole that communicates with the suction pump, and air in the space is sucked out through the through hole when the suction pump is activated.

11. The ink-jet printing device according to claim 10;

wherein the supporting member is an elongated shape and is formed, at one of two opposite ends thereof, with a groove that communicates with the through hole in the base when the supporting member is disposed in the cap.

12. The ink-jet printing device according to claim 11;

wherein the supporting member is formed, on the bottom surface thereof, with another groove extending in a longitudinal direction of the supporting member.

13. An ink-jet printing device comprising:

an ink-jet printing head; and a purging unit;

the purging unit comprising:

a cap having a base and a lip, wherein the lip extends from the base;

a suction pump; and a supporting member;

wherein the supporting member is located inside the cap;

wherein a space is formed between the cap and the ink-jet printing head when the cap is brought into abutment with the ink-jet printing head;

wherein the suction pump lowers the pressure of the space when the suction pump is activated;

wherein a hermetic seal is formed between the lip of the cap and the ink-jet printing head when the cap is brought into abutment with the ink-jet printing head; and wherein the supporting member moves in a direction away from the base of the cap when the suction pump is activated, thereby supporting the lip so that the hermetic seal between the lip of the cap and the ink-jet printing head is maintained.

14. The ink-jet printing device according to claim 13;

wherein the lip comprises a distal end portion, the distal end portion having a V-shaped cross section;

wherein the distal end portion has (1) a contact surface that comes into abutment with the ink-jet printing head, (2) a first inclined surface extending away from the contact surface inwardly of the lip, and (3) a second inclined surface, contiguous to the first inclined surface, extending outwardly of the lip toward the base at an acute angle to the first inclined surface;

wherein the supporting member has an abutment portion which faces away from the base of the cap; and wherein the abutment portion of the supporting member is formed with a shoulder surface that comes into abutment with the second inclined surface so as to support the second inclined surface.

15. An ink-jet printing device according to claim 13;

wherein the base and the lip are integrally formed of rubber, and wherein at least a portion of the base corresponding to the inner side of the lip is formed to be thinner than the lip itself, so as to be capable of being deformed easily in comparison with the lip when the pressure in the space is lowered.

16. The ink-jet printing device according to claim 15;

wherein the lip comprises a distal end portion, the distal end portion having a V-shaped cross section;

wherein the distal end portion has (1) a contact surface that comes into abutment with the ink-jet printing head, (2) a first inclined surface extending away from the contact surface inwardly of the lip, and (3) a second inclined surface, contiguous to the first inclined surface, extending outwardly of the lip toward the base at an acute angle to the first inclined surface;

wherein the supporting member has an abutment portion which faces away from the base of the cap; and wherein the abutment portion of the supporting member is formed with a shoulder surface that comes into abutment with the second inclined surface so as to support the second inclined surface.

* * * * *